US007780885B2

(12) United States Patent
Bernabei et al.

(10) Patent No.: US 7,780,885 B2
(45) Date of Patent: Aug. 24, 2010

(54) HIGH PRESSURE CASTING METHOD FOR ARTICLES OF SANITARYWARE AND A MACHINE IMPLEMENTING THE METHOD

(75) Inventors: Alessandro Bernabei, Imola (IT); Stefano Scardovi, Anita Di Argenta (IT)

(73) Assignee: Sacmi Cooperativa Meccanici Imola Societa Cooperativa, Imola (IT)

( * ) Notice: Subject to any disclaimer, the term of this patent is extended or adjusted under 35 U.S.C. 154(b) by 636 days.

(21) Appl. No.: 10/545,171

(22) PCT Filed: Aug. 18, 2004

(86) PCT No.: PCT/IB2004/002701

§ 371 (c)(1),
(2), (4) Date: Jun. 16, 2006

(87) PCT Pub. No.: WO2005/021226

PCT Pub. Date: Mar. 10, 2005

(65) Prior Publication Data

US 2006/0249866 A1 Nov. 9, 2006

(30) Foreign Application Priority Data

Sep. 3, 2003 (IT) ..... BO2003A0506

(51) Int. Cl.
*B28B 1/26* (2006.01)

(52) U.S. Cl. ..... 264/87; 264/86; 425/84; 425/85; 425/405.1

(58) Field of Classification Search ..... 264/87, 264/86; 425/85, 84, 405.1
See application file for complete search history.

(56) References Cited

U.S. PATENT DOCUMENTS

| | | | | | |
|---|---|---|---|---|---|
| 4,500,681 | A | * | 2/1985 | Shulman | 525/222 |
| 4,591,472 | A | * | 5/1986 | Gerster | 264/87 |
| 4,798,525 | A | * | 1/1989 | Sato et al. | 425/84 |
| 4,832,890 | A | * | 5/1989 | Sato et al. | 264/87 |
| 5,083,911 | A | * | 1/1992 | Hisaeda et al. | 425/84 |
| 5,741,388 | A | * | 4/1998 | Gerster et al. | 156/245 |
| RE37,114 | E | * | 3/2001 | Youngs et al. | 405/52 |

* cited by examiner

*Primary Examiner*—Eric Hug
*Assistant Examiner*—Jacob Thomas Minskey
(74) *Attorney, Agent, or Firm*—Pearne & Gordon LLP

(57) ABSTRACT

The invention relates to a high pressure casting method for producing articles of sanitaryware and to a machine implementing the method. The method of type "A" comprises the steps of forming the thickness of the sanitaryware article, emptying the excess slip out of the mould and consolidating the article, all these steps being performed at a constant pressure equal in value to the maximum pressure of the step in which the thickness of the article is formed. In the method of type "B", the steps of emptying out the excess slip and consolidating the sanitaryware article (14) are performed at a pressure equal to 75% of the maximum pressure of thickness formation. The casting machine comprises a discharge device for draining out the excess slip through a calibrated valve that enables the slip to be discharged without decreasing the pressure in the mould. Compared to prior art casting methods, the moulds and the sanitaryware articles are therefore subjected to less stress and strain and the time required to complete a casting cycle is significantly reduced.

21 Claims, 2 Drawing Sheets

FIG. 3
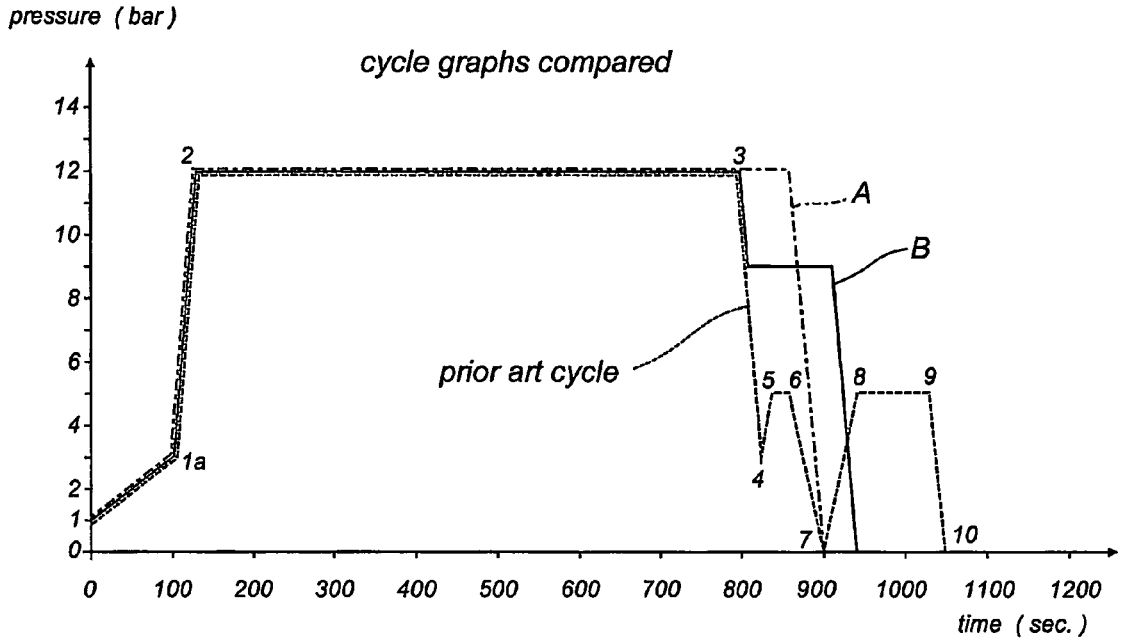
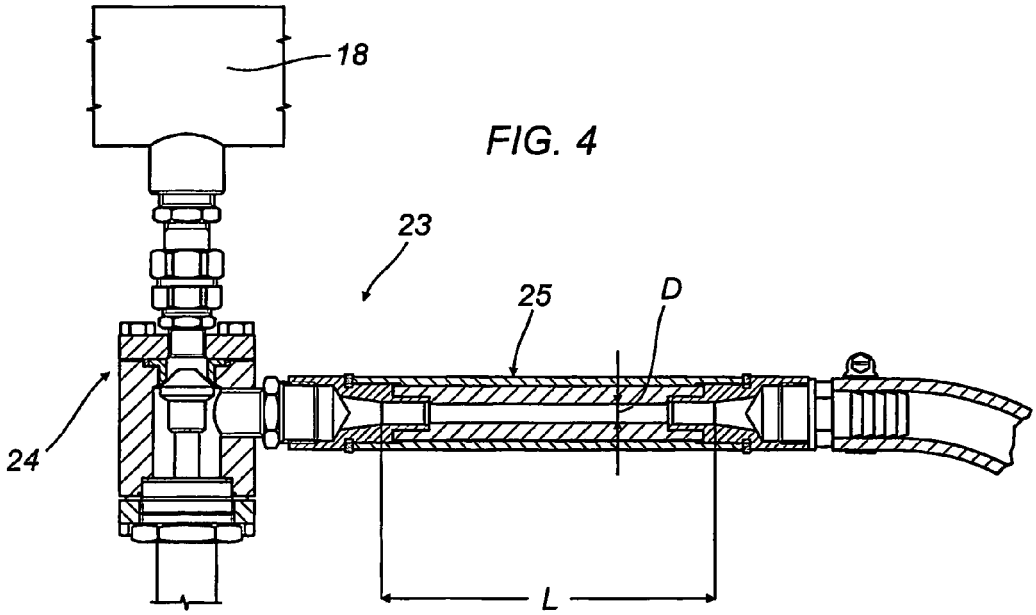
FIG. 4

HIGH PRESSURE CASTING METHOD FOR ARTICLES OF SANITARYWARE AND A MACHINE IMPLEMENTING THE METHOD

TECHNICAL FIELD

The present invention relates to a method for the high pressure casting of articles of sanitaryware.

More specifically, the invention concerns improvements to the method currently used for casting articles of sanitaryware under high pressure using porous resin moulds consisting two or more parts.

The invention also relates to a high pressure casting machine for producing sanitaryware. Compared to prior art, the machine presents a number of modifications that make it suitable for implementing the method according to the invention.

BACKGROUND ART

Document U.S. Pat. No. 5,083,911 describes a high pressure casting method for producing sanitaryware.

The diagram of FIG. 1 shows a typical example of a time/pressure graph of a pressure casting mould. More specifically, the method according to prior art comprises the steps described below.

The parts of the mould, or moulds in the case of a machine with two or more moulds, are closed and clamped to each other.

In other terms, there is a mould closing step: the way this is done and the time taken depend on the type of installation (casting bench) and on the number of moulds installed.

During this step, the pressure is not varied and remains at the level of atmospheric pressure.

The mould closing step is followed by a step of cleaning the supply pipe leading to the mould with a new ceramic mixture. The mixture will hereinafter be referred to as "slip".

The slip is made to circulate inside the main supply pipe so as to remove any impurities and condition the pipe itself before the mould is filled with the slip.

Next, the discharge valve is closed and the mould is filled with the new slip. At the same time the slip also enters a pressurising device connected to the slip supply pipe.

During this step, there is an increase in the pressure, represented by the first section 1-1*a* in the time/pressure graph.

This is followed by a first step of forming the thickness of the sanitaryware article. In this step, the walls of the article develop thickness as the pressure is increased to a predetermined level and for a length of time corresponding to section 1*a*-2 of the graph of FIG. 1.

The pressure applied to the slip by the pressurising device forces the water in the slip out through the mould pores and is drained out through appropriate passages formed in the mould. These passages may be connected to a vacuum source such as to facilitate the drainage of the water out of the mould by the resulting suction effect.

This creates a layer of ceramic material that is deposited and adheres to the inside walls of the mould to start forming the shape of the sanitaryware article.

This is followed by a second step of forming the thickness of the sanitaryware article at a constant pressure for a length of time corresponding to section 2-3 of the graph of FIG. 1.

When the ceramic material has formed a layer of predetermined thickness inside the mould, the pressurising device is switched off, this step corresponding to section 3-4 of the graph of FIG. 1.

Next, the discharge valve is opened and a compressed air valve is also opened so as to blow a jet of compressed air through the article in order to force the excess slip out through a drainage pipe.

This step is represented by sections 4-5-6-7 in the graph of FIG. 1 which show an intermediate increase in the pressure caused by the counterpressure created by the discharging of the excess slip.

Next, once all the excess slip has been discharged, the discharge valve is closed and compressed air is injected so as to pressurise the article again.

Next, there is a first step of consolidating the thickness of the sanitaryware article by increasing the pressure of the compressed air for a length of time corresponding to section 7-8 of the graph FIG. 1.

This is followed by a second step of consolidating the thickness of the sanitaryware article by injection of compressed air at a constant pressure for a length of time corresponding to section 8-9 of the graph FIG. 1.

The article is then subjected to a decompression step: the air pressure is allowed to fall from the maximum consolidation value to a value substantially equal to atmospheric pressure, corresponding to section 9-10 of the graph of FIG. 1.

The last steps in the process are the opening of the mould—or the moulds in the case of a machine with two or more moulds—and the demoulding of the article inside.

The times and methods of performing the opening and demoulding steps depend on the type of installation (casting bench) and on the number of moulds installed, as for the mould closing step at the start of the casting method described here.

The casting method according to prior art includes several steps in which the sanitaryware article is subjected to sudden pressure variations where the pressure is increased or decreased. The pulsation caused by these pressure changes on the mould and article being formed may lead to problems.

The efficiency of the resin mould may be seriously reduced mainly on account of cracking of the mould itself or clogging of the open pores that control the filtration process.

The continual stress caused by the pressure pulsation thus leads to damage not only to the moulds themselves but also to the articles cast in the moulds.

Another disadvantage connected directly with the stress on the sanitaryware articles is the restriction it poses on the design of the articles themselves, which means that their geometry and form (thickness, curvature radius, passage from free to constrained thickness).

Moreover, the maximum casting pressure cannot exceed certain limits so as to avoid creating excessive strain and demanding fatigue cycles on the moulds and sanitaryware.

This also means that the casting rate cannot be further increased and the productivity of the casting machine therefore remains relatively low.

DISCLOSURE OF THE INVENTION

One object of the present invention is to provide an improved high pressure casting method for producing articles of sanitaryware that makes it possible to reduce or eliminate the pressure pulsation on the moulds and sanitaryware articles.

Another object of the invention is to provide a high pressure casting method for producing articles of sanitaryware that makes it possible to reduce production times.

According to one aspect of it, the present invention provides a high pressure casting method for producing sanitaryware as defined in claim 1.

Yet another object of the invention is to provide an improved pressure casting machine for producing articles of sanitaryware in which pressure pulsation during casting cycles is totally eliminated or considerably dampened.

According to another aspect of it, the present invention provides a pressure casting machine for producing sanitaryware as defined in claim 6.

The dependent claims describe preferred, advantageous embodiments of the invention.

BRIEF DESCRIPTION OF THE DRAWINGS

The preferred embodiments of the invention will now be described, without restricting the scope of the inventive concept, with reference to the accompanying drawings in which:

FIG. 3 is a graph representing the pressure over time inside a mould in a high pressure casting machine during a casting cycle according to prior art compared with two different casting cycles according to the invention; and FIG. 4 is a section view of a part of the high pressure casting machine according to the invention.

DETAILED DESCRIPTION OF THE PREFERRED EMBODIMENTS OF THE INVENTION

Figure 1:
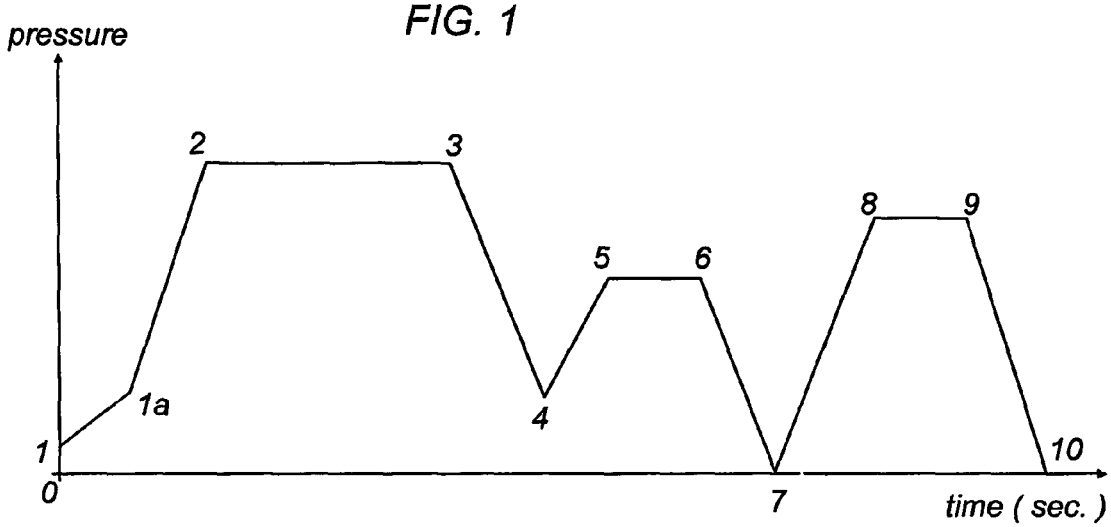
FIG. 1 is a graph representing the pressure over time inside a mould in a high pressure casting machine according to prior art.

With reference to the accompanying drawings, the high pressure casting machine 11 according to the invention comprises a mould 12 consisting of at least two parts. The mould 12 presents a cavity 13 inside which a sanitaryware article 14 is formed.

In the example illustrated, the machine has a single mould but it will be understood that the present invention may be applied to multiple mould machines without significantly changing the casting machine or method.

The cavity 13 in the mould 12 is connected through a first pipe 15 to a source of compressed air (not illustrated) and through a second pipe 16 to a source of slip 17. Through a branch 18 of the second pipe 16 the excess slip can be channelled out to a discharge device 19 described in more detail below.

The pipe 16 is also connected to a pressurising device 20 connected through a third pipe 21 to a pressure source (not illustrated).

In known manner, the pressurising device 20 applies pressure to the cavity 13 in the mould 12.

The discharge device 19 comprises a first, full opening valve 22 and a second, calibrated valve 23, each valve 22, 23 being connected to a respective tank.

The structure of the calibrated valve 23 is illustrated in FIG. 4 and comprises a customary driven shutter 24 which places the inlet of the valve 23, connected to the branch 18, in communication with a calibrated pipe 25.

More specifically, the pipe 25 has a section of length "L" whose diameter is "D" so as to offer a constant predetermined resistance to the passage of the slip. Preferably, the pipe 25 is replaceable and is made of an elastomeric material so as to better resist wear due to the passage of the slip.

In particular, the structure of the valve 23 enables the pressure inside the cavity 13 to be maintained at a level above atmospheric pressure. The pressure obtainable is a function of the pressure inside the cavity 13 and of the dimensions "L" and "D" of the pipe 25.

Figure 2:
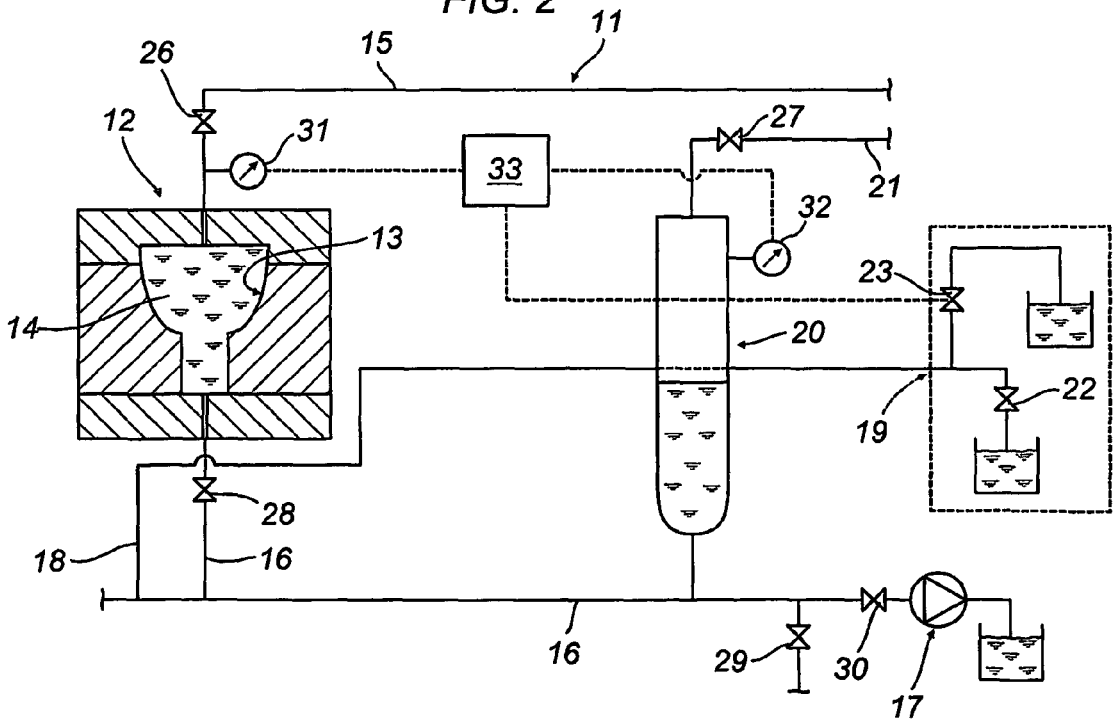
FIG. 2 is a schematic view of a high pressure casting machine according to the invention.

As illustrated in FIG. 2, the machine 11 comprises shutoff valves 26, 27 for interrupting the flow of compressed air, and a series of valves 28, 29 and 30 on the pipes through which the slip passes. Also, the mould 12 and the pressurising device 20 are fitted with respective pressure gauges 31, 32.

The compressed air shutoff valves 26, 27, the valves 28, 29 and 30 on the slip pipe, the pressure gauges 31, 32 and, in particular, the discharge device 19, which comprises the first, full opening valve 22 and the second, calibrated valve 23, are connected to a unit 33 that controls the sanitaryware production cycle.

The structure of the valve 23 and the operating modes controlled by the control unit 33 enable the production cycle to be carried out without varying the pressure between one step and another.

Two embodiments of the high pressure casting method according to the invention are represented in FIG. 3 and are compared with a cycle according to a prior art method, represented in FIG. 1.

The new cycles according to the invention differ in the way the emptying and consolidation steps are carried out.

In the prior art cycle, the thickness formation step is followed by a step of decompressing the machine to a pressure value that is almost the same as the pressure at which the next emptying step is carried out (2-3 bar). The pressure difference is approximately 70-80% of the value of the maximum casting pressure.

During the emptying step, the machine undergoes further pressure variations, either up or down.

At the end of the emptying step, which normally produces a fall in pressure to values approaching zero, the machine pressurises the moulds again so that the consolidation step can be performed.

After consolidation, the moulds are decompressed completely before the moulds are opened.

In the first embodiment of the method according to the invention ("A" type cycle), the machine is maintained at a pressure that is substantially the same as the maximum casting pressure (12-13 bar) even during the emptying and consolidation steps. This is made possible by the use of the new type of calibrated valve 23 which prevents the pressure in the mould 12 cavity 13 from falling while at the same time allowing the excess slip to be drained out.

The system is not decompressed completely until just before the moulds are opened.

In the second embodiment (cycle type "B"), there is a slight decrease in pressure at the end of the thickness formation step.

Nevertheless, the pressure is decreased to a much lesser extent than in the prior art cycle and is, moreover, maintained at a constant level during the emptying and consolidation steps until just before the moulds are opened.

Below are two tables showing an example of a casting cycle of prior art type and an example of a new casting cycle according to the invention.

The time intervals and pressure ranges for the different steps in each cycle depend essentially on the following characteristics: the type of casting bench used, the type of sanitaryware article to be made, the number of moulds installed and the technological properties of the slip used.

TABLE 1

Prior art cycle

| Cycle step | Time (seconds) | Pi Starting pressure (bar) | Pf Ending pressure (bar) |
|---|---|---|---|
| Mould closing | 30-60 | | |
| Cleaning the supply pipe with slip | 20-40 | 1-2 | 2-3 |
| Filling | 90-200 | 1-2 | 2-3 |
| Thickness formation 1 | 10-60 | 2-3 | 12-13 |
| Thickness formation 2 | 300-800 | 12-13 | 12-13 |
| Decompression of article | 10-30 | 12-13 | 3-1 |
| Emptying | 30-120 | 5-3 | 1 |
| Consolidation 1 | 0-60 | 1-2 | 3-5 |
| Consolidation 2 | 30-150 | 3-5 | 3-5 |
| Decompression of article | 10-30 | 3-5 | 0-1 |
| Mould opening | 30-120 | | |
| Air to moulds | 15-30 | 2-4 | 2-4 |

TABLE 2

New cycle

| Cycle step | Time (seconds) | Pi Starting pressure (bar) | Pf Ending pressure (bar) |
|---|---|---|---|
| Mould closing | 30-60 | | |
| Cleaning the supply pipe with slip | 20-40 | 1-2 | 2-3 |
| Filling | 90-200 | 1-2 | 2-3 |
| Thickness formation 1 | 10-60 | 2-3 | 12-13 |
| Thickness formation 2 | 300-800 | 12-13 | 12-13 |
| Emptying | 10-60 | 9-13 | 9-13 |
| Consolidation | 0-60 | 9-13 | 9-13 |
| Decompression of article | 10-30 | 9-13 | 0-1 |
| Mould opening | 30-120 | | |
| Air to moulds | 15-30 | 2-4 | 2-4 |

The steps indicated in italics in the tables are the steps that have been modified in passing from the prior art casting cycle to the new casting cycle.

The invention brings important advantages, as listed below:

a) Shorter casting cycle. The reduction in time can be estimated at around 1-4 minutes (on existing casting machines) depending on the type of casting bench and slip used and on the type of article to be made. Expressed as a percentage, the reduction in the cycle time is 10-20%. As is known, the cycle time is inversely proportional to the productivity of the casting machine, which means that the new cycle according to the invention increases the productivity of the casting machine.

b) Longer mould life. The efficiency of a resin mould may be seriously reduced mainly on account of cracking of the mould itself or clogging of the open pores that control the filtration process. The new casting method considerably reduces the pressure pulsation to which the mould is subjected during work. This decreases the mechanical strain caused by continual compression and traction, thus reducing damage to the resin mould.

c) Less tensional stress on the sanitaryware during the casting cycle. For the same reason, the semifinished articles of sanitaryware are subjected to less tensional stress, thus reducing the number of articles to be rejected.

d) A direct consequence of the previous point is the greater degree of freedom in sanitaryware design. It is known that pressure casting causes the sanitaryware article to accumulate tension, which must be taken into account when designing the sanitaryware and which poses considerable restrictions on the geometrical shape and form of the articles designed (thickness, curvature radius, passage from free to constrained thickness).

e) The reduced build-up of tension in the article being made means that designers are freer to concentrate on the geometry and appearance of the sanitaryware they are designing.

f) The advantage listed at point c) also makes it possible to increase the maximum casting pressure used in the production of sanitaryware, currently restricted to around 12-13 bar. This reduces cycle time and hence increases the productivity of the casting machine.

The invention as described above may be modified and adapted in several ways without thereby departing from the scope of the inventive concept as defined in the claims.

Moreover, all the details of the invention may be substituted by technically equivalent elements.

LIST OF REFERENCE CHARACTERS

0-10 Points in time/pressure graph
11 High pressure casting machine
12 Mould
13 Mould cavity
14 Sanitaryware article
15 First compressed air pipe
16 Second slip pipe
17 Source of slip
18 Branch of the second pipe 16
19 Discharge device
20 Pressurising device
21 Third compressed air pipe
22 Full opening valve
23 Calibrated valve
24 Shutter
25 Calibrated pipe
26, 27 Compressed air shutoff valves
28-30 Valves on slip pipe
31-32 Pressure gauges
33 Control unit

The invention claimed is:

1. A high pressure casting method in a machine for producing an article of sanitaryware using a ceramic mixture or slip, the machine being equipped with at least one mould comprising at least two parts, the method comprising in sequence the steps of: closing the mould; filling the mould with slip; first thickness formation of the sanitaryware article by increasing the pressure in the mould; second thickness formation of the sanitaryware article by providing pressure in the mould effective to force water in the slip out through the mould; emptying non-solidified excess slip out of the mould; after the emptying step, consolidating the sanitaryware article in the mould by providing pressure in the mould greater than atmospheric pressure for a time sufficient to effectively complete consolidation of the sanitaryware article; decompressing the mould until the pressure in the mould is substantially equal to atmospheric pressure; opening the mould; and demoulding the sanitaryware article thus formed, wherein pressure in the mould is not increased after the second thickness formation step and up through the consolidating step.

2. The method of claim 1, wherein during the step of second thickness formation, a maximum pressure is reached and said maximum pressure is thereafter maintained substantially constant in said mould through the remainder of the second thickness formation step, through the emptying step and through the consolidating step.

3. The method of claim 2, wherein said maximum pressure is between 12 bar and 35 bar.

4. The method of claim 2, wherein said maximum pressure is between 12 bar and 13 bar.

5. The method of claim 1, wherein the pressure in the mould during the emptying step is between 9 bar and 13 bar.

6. The method of claim 1, wherein a maximum pressure in the mould is used during the second thickness formation step, and wherein the emptying step and the consolidating step occur at one or more pressures below the maximum pressure used during the second thickness formation step.

7. The method of claim 6, wherein a maximum pressure in the mould is used during the emptying and consolidating steps, and wherein the maximum pressure in the mould during the emptying and consolidating steps is about 75% of the maximum pressure in the mould during the second thickness formation step.

8. The method of claim 6, wherein the pressure in the mould during the emptying and consolidating steps is between 9 bar and 13 bar.

9. The method of claim 6, wherein the maximum pressure in the mould during the emptying and consolidating steps is between 9 bar and 27 bar.

10. The method of claim 1, wherein, after a maximum pressure in the mould is reached during the second thickness formation step, the pressure in the mould thereafter, through the step of decompressing the mould, is decreased or maintained but not increased.

11. The method of claim 1, wherein, after a maximum pressure in the mould is reached during the second thickness formation step, the pressure in the mould thereafter, through the consolidating step, is decreased or maintained but not increased.

12. The method of claim 1, wherein during the step of second thickness formation a maximum pressure is reached, said maximum pressure being between 12 bar and 35 bar.

13. The method of claim 1, wherein during the step of second thickness formation a maximum pressure is reached, said maximum pressure being between 12 bar and 13 bar.

14. The method of claim 1, wherein pressure in the mould is maintained at a constant level during the emptying and consolidating steps.

15. A high pressure casting machine for producing an article of sanitaryware through steps including first thickness formation of the article, second thickness formation of the article, emptying non-solidified excess slip out of mould, consolidating the article, and opening the mould, the machine comprising: at least one mould comprising at least two parts, wherein the mould comprises a cavity within which the sanitaryware article may be formed, the cavity being connected through a first pipe to a source of compressed air and through a second pipe to a source of slip equipped with a pump, the second pipe being connected to a discharge device and to a pressurizing device, said pressurizing device being distinct from the source of slip, wherein the discharge device comprises a first, full opening valve and a second, calibrated valve provided along distinct respective pipes for passage of the excess slip, a third valve being provided along the second pipe between the mould and the pressurizing device, said third valve being distinct from said first, full opening valve and from said second, calibrated valve, wherein said second, calibrated valve is configured to control drainage of the excess slip so that pressure in the mould is not increased after the second thickness formation step and up through the consolidating step.

16. The casting machine of claim 15, wherein the first, full opening valve and the second, calibrated valve are each connected to a respective tank, both tanks being distinct from the source of slip.

17. The casting machine of claim 15, wherein the second, calibrated valve comprises a pipe with a section of length "L" whose diameter is "D", "L" and "D" being selected to permit pressure in the mould to be maintained or decreased but not increased after the second thickness formation step and up through the consolidating step.

18. The casting machine of claim 17, wherein the length "L" and the diameter "D" have a ratio L/D of between 10 and 20.

19. The casting machine of claim 17, wherein said section is replaceable.

20. The casting machine of claim 19, wherein said section is made of elastomeric material.

21. The casting machine of claim 15, wherein the second, calibrated valve is also configured so that pressure in the mould is not decreased after the second thickness formation step and up through the consolidating step.

* * * * *